US005345666A

United States Patent [19]

Matyja

[11] Patent Number: 5,345,666

[45] Date of Patent: Sep. 13, 1994

[54] METHOD OF SEALING A TANK HAVING A FLEXIBLE SHEET LINER THEREIN

[75] Inventor: Ronald M. Matyja, Wheeling, Ill.

[73] Assignee: Culligan International Company, Northbrook, Ill.

[21] Appl. No.: 106,125

[22] Filed: Aug. 12, 1993

Related U.S. Application Data

[60] Division of Ser. No. 949,907, Sep. 23, 1992, abandoned, which is a division of Ser. No. 895,215, Jun. 8, 1992, Pat. No. 5,174,466, which is a continuation of Ser. No. 691,564, Apr. 25, 1991, abandoned.

[51] Int. Cl.[5] ..... B23P 15/00

[52] U.S. Cl. ..... 29/451; 29/455.1

[58] Field of Search ..... 29/890.036, 450, 451, 29/454, 402.02

[56] References Cited

U.S. PATENT DOCUMENTS

| | | | |
|---|---|---|---|
| 663,866 | 12/1900 | Copperfield et al. . | |
| 3,020,192 | 2/1962 | Stephens et al. | 29/451 |
| 3,219,230 | 11/1965 | Housz et al. . | |
| 3,247,999 | 4/1966 | Stilwell . | |
| 3,377,766 | 4/1968 | Nelson . | |
| 3,432,069 | 3/1969 | Craig . | |
| 3,437,231 | 4/1969 | Carpenter, Jr. . | |
| 3,450,254 | 6/1969 | Miles | 29/451 |
| 4,164,304 | 8/1979 | Roberson . | |
| 4,537,329 | 8/1985 | Norton . | |
| 4,765,507 | 8/1988 | Yavorsky et al. . | |
| 4,996,760 | 3/1991 | Coleman | 29/454 |
| 5,046,634 | 9/1991 | McFarlin et al. . | |
| 5,174,466 | 12/1992 | Matyja . | |

FOREIGN PATENT DOCUMENTS

| | | | |
|---|---|---|---|
| 175646 | 10/1983 | Japan | 29/454 |

*Primary Examiner*—Mark Rosenbaum
*Assistant Examiner*—David P. Bryant
*Attorney, Agent, or Firm*—Gerstman, Ellis & McMillin, Ltd.

[57] ABSTRACT

A tank lining system comprises a tank having a wall defining a first opening. A flexible sheet lining abuts the interior surface of the wall and defines a second opening that is aligned with the first opening of the tank wall. A first collar surrounds the first opening and is attached to the tank, while a second collar surrounds the second opening and is attached to the flexible sheet. Means are provided for retaining the first and second collars together with a seal of the junction area between them. The tank is sealed by removing air from between the lining and the tank prior to inserting the seal between the collars.

3 Claims, 2 Drawing Sheets

Fig. 1
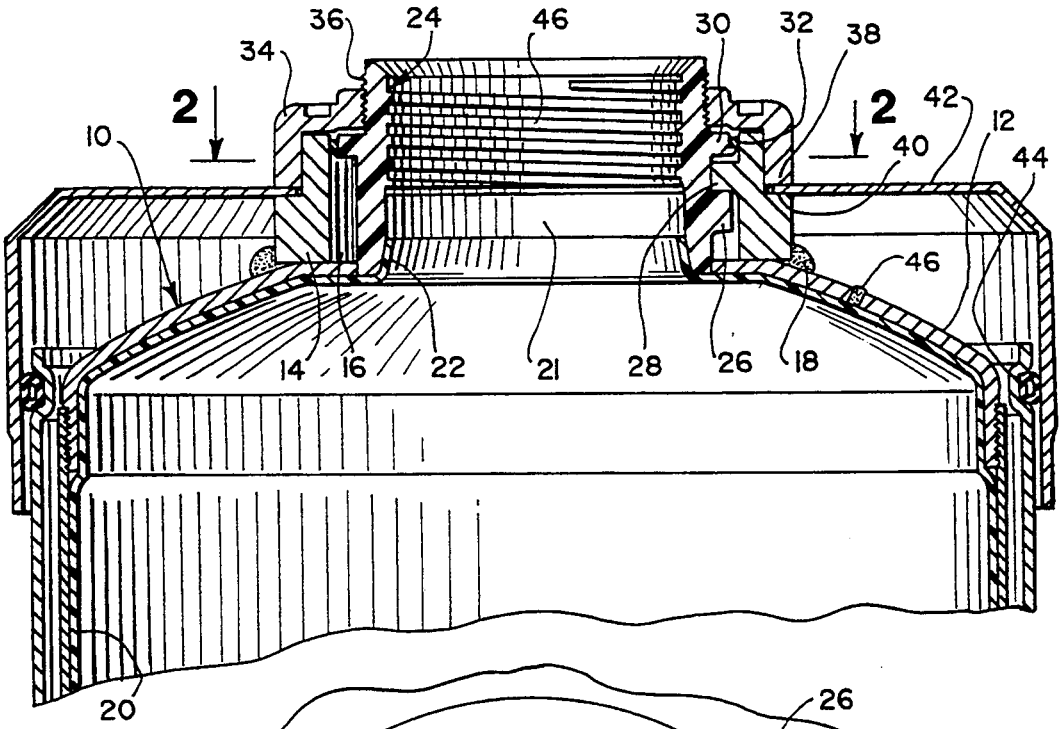
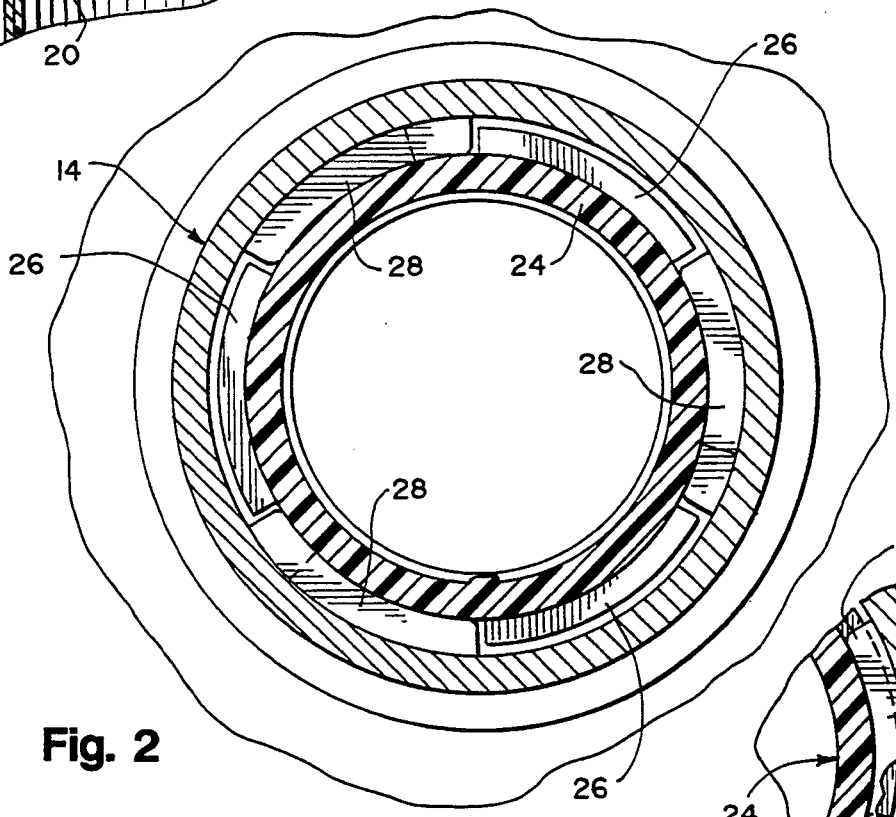
Fig. 2
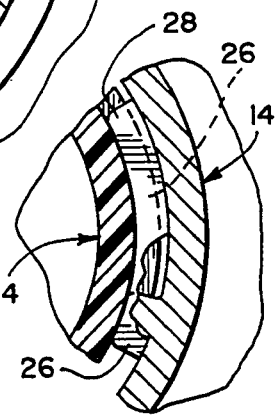
Fig. 3

METHOD OF SEALING A TANK HAVING A FLEXIBLE SHEET LINER THEREIN

This application is a division of application Ser. No. 07/949,907, filed Sep. 23, 1992 (abandoned), which is a division of application Ser. No. 07/895,215, filed Jun. 8, 1992, now U.S. Pat. No. 5,174,466; which is a continuation of application Ser. No. 07/691,564, filed Apr. 25, 1991 (abandoned).

BACKGROUND OF THE INVENTION

Various water tanks and the like are desirably lined with a flexible plastic barrier to prevent corrosion of the tank, or the leaching of undesirable substances. This is especially the case when the tank body is made of steel which, apart from the corrosion problem, can exhibit significant advantages over other materials.

As described in U.S. Pat. No. 4,537,329, a system is provided for connecting a plastic tank lining to a penetration fitting which forms an opening through a tank wall. By this present invention, an improved structure for a tank lining system is provided which is easier to assemble, and which provides an air and water tight seal between the liner and the tank without the use of sealants or direct compression gaskets. A direct compression gasket is a gasket which is under constant compression. A disadvantage of such a gasket is that, over a period of time it can take a compression set due to the constant pressure and can lose effectiveness.

Likewise, the time and effort required to place the tank lining system into a tank is reduced in this invention over prior art systems, while excellent results of sealing and durability are achieved.

Additionally, The Culligan International Company has sold a tank lining system where a yoke is required. By this invention such a yoke is eliminated.

DESCRIPTION OF THE INVENTION

By this invention, a tank lining system comprises a tank having a wall defining a first opening. A flexible sheet lining abuts the interior surface of the wall and defines a second opening that is aligned with the first opening of the tank wall. A first collar surrounds the first opening, the first collar being attached to the tank, typically by welding when the tank is metal and the first collar is made of a metal which is compatible to the metal of the tank. For example, both the tank and the first collar may be made of steel.

A second collar surrounds the second opening, and is attached by an appropriate sealing to the flexible sheet, for example radio frequency (RF) heat sealing, solvent welding, spin welding, ultrasonic welding, contact heating, or any other desired process. Typically, the flexible sheet may be made of vinyl plastic or polyurethane sheeting, with the second collar being made of a corresponding, but typically rigid, plastic which is sealingly compatible with the plastic of the sheet.

Means are provided for retaining the first and second collars together, while providing a seal of the junction area that is defined between them.

Preferably, the first and second collars carry an O-ring between them for sealing the junction area, with the O-ring comprising a seal of the non-direct compression type, as is the case with respect to O-rings, for an improved lifetime of the seal.

It is also preferred for the second collar to be surrounded by the first collar in retained-together relation.

This retained-together relation can be accomplished simply by attaching with bolts if desired. However, preferably, the first collar may define spaced, inwardly projecting first locking flange means, while the second collar defines spaced, outwardly projecting second locking flange means which are proportioned to pass axially through and to rotationally interlock with the first locking flange means. Thus, relative rotation of the first and second collars with their respective locking flange means positioned for interlocking can cause the two collars to enter into rotationally interlocking relation with each other through the respective locking flanges, to cause axial locking together.

Also, it may be desired to provide nut means threadedly connected to the second collar and abutting the first collar to force, upon rotation of the nut means, the first and second locking flange means into axially loaded relation together.

It is preferred at some time of the assembly process to pressurize with air or liquid the emplaced, flexible liner in the tank, so that air bubbles between the inner wall of the tank and the flexible liner are forced out of the system, either through one or more vent holes or through the junction area between the first and second collars prior to applying a seal of that junction area. Then, upon applying the seal, the space between the tank and the sheet lining is essentially sealed and stays that way since, after sealing of the system, air cannot migrate back into the space between the tank wall and the flexible plastic liner.

DESCRIPTION OF THE DRAWINGS

FIG. 1 is a fragmentary, longitudinal sectional view of a water tank having a tank lining system in accordance with this invention;

FIG. 2 is a sectional view taken along line 2—2 of FIG 1, showing the system in the process of assembly;

FIG. 3 is a fragmentary, sectional view similar to FIG. 2, showing the system in its assailed form.

DESCRIPTION OF SPECIFIC EMBODIMENTS

Figure 4:
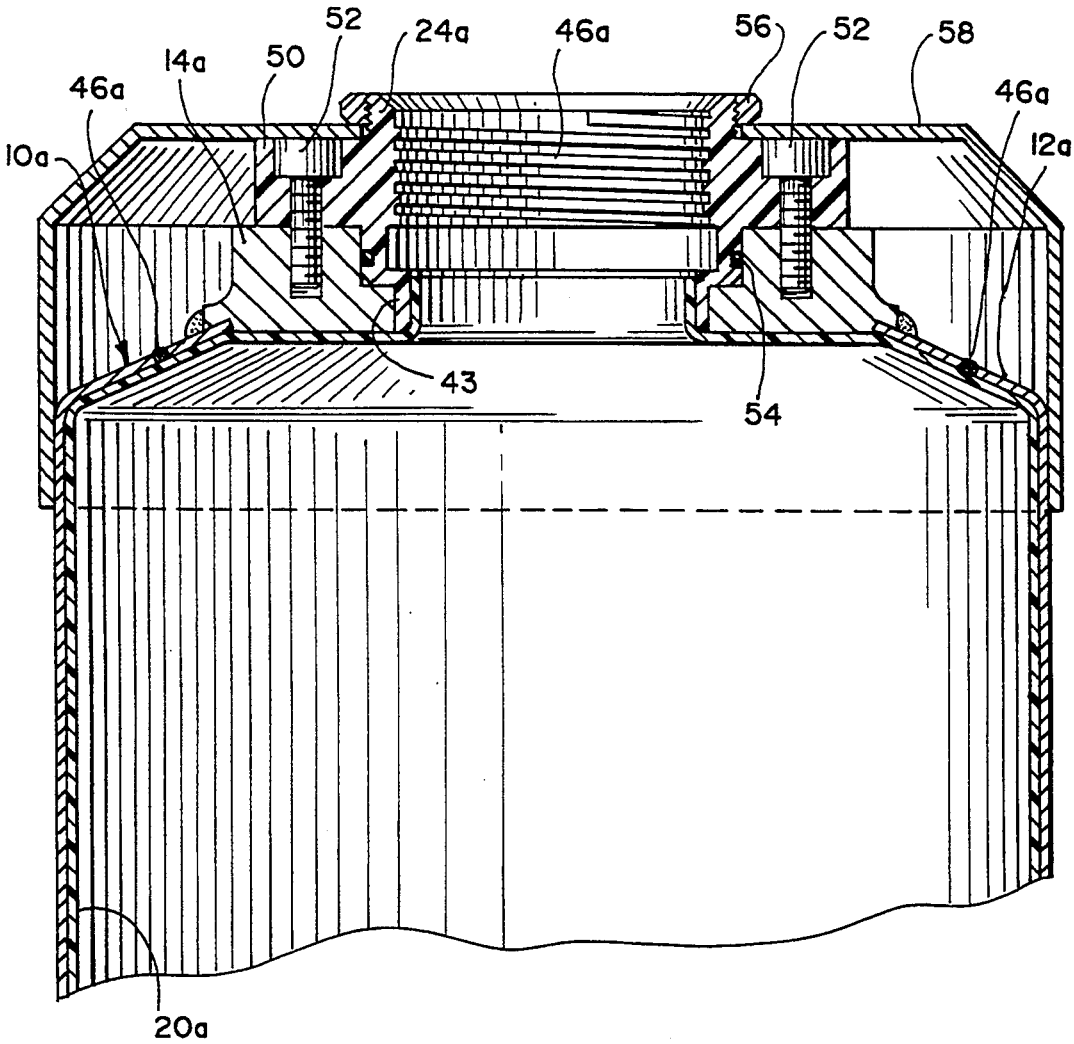
FIG. 4 is a fragmentary, longitudinal sectional view of a water tank which carries an alternate embodiment of the tank lining system of this invention.

Referring to FIGS. 1 through 3, a steel water tank 10 is disclosed comprising a tank wall 12, to which there is attached a steel first collar 14 which defines a first opening 16. First collar 14 is welded by annular weld line 18 to the remainder of tank wall 12.

Tank 10 carries an inner plastic liner 20 made of polyvinyl chloride plastic or the like. At the upper end of said plastic liner 20 there is an aperture 21, with an annular section 22 of plastic liner 20 being firmly sealed to second collar 24 by R.F. sealing or the like. Second collar 24 may be made of rigid polyvinyl chloride, as is desirable in such a circumstance to promote sealing compatibility. Second collar 24 fits within first collar 14 in telescoping relation so that a portion of second collar 24 is surrounded by first collar 14.

Second collar 24 defines, in this embodiment, three outwardly projecting locking flanges 26. As shown in FIG. 2, locking flanges 26 are spaced from each other by spaces that are of typically slightly larger circumferential angle than the circumferential angle of each locking flange 26.

First collar 14, in turn, defines three inwardly projecting, spaced locking flanges 28. Each of the locking flanges 26, 28 are proportioned and spaced so that they can fit between each other, as particularly shown in FIG. 2, when the first and second collars 14, 24 are moved axially with respect to each other. Thus, the respective collars can be placed into a position as illustrated in FIG. 1 and also FIG. 3 by passing through the configuration of FIG. 2, and then relatively rotating first and second collars 14, 24 to the position of FIGS. 1 and 3 where the respective locking flanges 26, 28 are placed in rotationally interlocking relation, to retain the respective collars 14, 24 together in axially locked relation.

Second collar 24 also defines an annular, outwardly projecting flange 30, which carries an O-ring 32. Thus, the junction area between the respective collars 14, 24 may be sealed by the presence of O-ring 32. However, prior to the insertion of O-ring 32 into the system, it is typically possible to inflate flexible liner 20 to press it tightly against wall 12 of the tank, to force virtually all air out of the junction area between liner 20 and wall 12, with the air migrating through the junction area between first and second collars 14, 24. Then, O-ring 32 may be inserted, to prevent migration of air back into the junction area between wall 12 and liner 20.

Following this, threaded nut 34 may be applied to external threads 36 of collar 24. The nut member is rotated downwardly until its flange 38 abuts an annular shoulder 40 of first collar 14, generating upward pressure on second collar 24 relative to first collar 14. This causes a load to be developed between the respective locking flanges 26, 28 for improved sealing and retention of the system.

Nut 34 may abut the shoulder 40 of first collar 14 through a shroud or cover 42, which may be made of sheet steel or the like, to protect the upper portion of the tank, as shown in FIG. 1. Shroud 42 also carries a lower annular seal member 44, which seals against the tank wall 12.

Thus, the tank lining system of this invention is provided with relatively simple construction, with the flexible tank liner carrying second collar 24 in sealed relation, so that the respective first and second collars are easily locked together and sealed without the complexities required in the prior art.

Second collar 24 also defines internal threads 46 in aperture 21, for attachment to a conventional adaptor.

If it is desired to further facilitate the draining of air from between wall 12 and flexible liner 20, one or more ports 46 may be formed in the wall 12 of the tank, to facilitate the bleeding of air bubbles from between the respective members 12, 20. Then, when the process is finished, port or ports 46 may be closed with a sealant or the like, as shown in FIG. 1. This may be used in conjunction with draining air through the junction area between first and second collars 14, 24, or it may be used as a substitute for that technique.

Referring to FIG. 4, another embodiment of the invention is shown. Water tank **10*a* comprises a wall 12*a* as in the previous embodiment, with wall 12*a* carrying a first collar 14*a*** in welded relation about a first opening, as in the previous embodiment.

The tank contains a flexible liner **20*a* which is bonded to a generally plastic second collar 24*a*** in a manner similar to the previous embodiment by any desired bonding means such as R.F. heat sealing, or any other desired process.

In this embodiment, the respective collars occupy a relation where the second collar **24*a* has a portion 43 which is surrounded by first collar 14*a*, but also, second collar 24*a* defines a collar section 50 which overlies first collar 14*a* in the manner shown. Collar section 50 and first collar 14*a* define apertures which receive retention bolts 52, to tightly secure the two collars 14*a*, 24*a* together. An O-ring 54 may be provided to seal the junction area between the two collars 14*a*, 24*a***.

As before, threads **46*a* are provided in an upper aperture 12*a* of the tank to facilitate the bleeding of air from the space between the tank wall 12 and flexible inner liner 20*a*, this being accomplished by pressurizing the interior of inner liner 20*a* by either compressed air or filling the tank with liquid. Then, apertures 46*a* may be closed up with sealant as shown, so that air cannot return to the junction between wall 12*a* and inner liner 20*a***.

As before, second collar **24*a* defines an internally threaded aperture 46*a*** for receiving a conventional connector or adaptor for the tank.

A threaded nut 56 may be provided in threaded relation with an externally threaded portion of second collar **24*a* to hold sheet metal shroud 58 onto the top of the tank. Shroud 58** provides external protection and provides the system with an aesthetic look.

Thus, by this invention, a simplified tank liner system is provided, which is easier to install and which exhibits excellent durability and useful life. The flexible liner 20 or **20*a*** is simply inserted into the mouth of the tank. The respective collars are secured together. The tank system is pressurized, or filled with water, to force the liner into intimate relation with the tank wall, and the system can be closed up and ready for years of useful life.

The above has been offered for illustrative purposes only, and is not intended to limit the scope of the invention of this application which is as defined in the claims below.

That which is claimed is:

1. The method of sealing a tank having a wall defining a first opening, and a flexible sheet liner abutting the interior surface of the wall and defining a second opening that is aligned with the first opening of said tank wall, with a first collar attached to the tank and surrounding the first opening, and a second collar surrounding the second opening and attached to the flexible sheet liner, with a portion of the second collar being surrounded by the first collar in retained-together relation, said method comprising;

removing air between said tank wall and said flexible sheet liner to cause the flexible sheet liner to enter into intimate contact with the tank wall, with said air removal taking place between the first collar and the second collar; and then inserting a seal between said first and second collars to prevent passage of air between the tank wall and the flexible sheet liner.

2. The method of claim 1 in which said seal is inserted by placing an O-ring of the non-direct compression type on a seat located between said first and second collars.

3. The method of claim 2 further including placing a single closure over said first and second collars and O-ring.

* * * * *